United States Patent [19]

Wheeler et al.

[11] Patent Number: 4,546,420

[45] Date of Patent: Oct. 8, 1985

[54] AIR COOLED LIGHT FIXTURE WITH BAFFLED FLOW THROUGH A FILTER ARRAY

[75] Inventors: David C. Wheeler, San Diego, Calif.; Douglas H. Blakeway, Lansley, Canada

[73] Assignee: Wheeler Industries, Ltd., San Diego, Calif.

[21] Appl. No.: 613,329

[22] Filed: May 23, 1984

[51] Int. Cl.[4] ..... F21V 9/08

[52] U.S. Cl. ..... 362/268; 362/19; 362/294; 362/218; 362/293; 362/264; 362/331; 362/276; 362/373

[58] Field of Search ..... 362/293, 294, 19, 218, 362/264, 268, 276, 331, 373

[56] References Cited

U.S. PATENT DOCUMENTS

| | | | |
|---|---|---|---|
| 3,116,022 | 12/1963 | Davis | 362/294 |
| 3,185,028 | 5/1965 | Andreoli | 362/294 X |
| 3,831,021 | 8/1974 | Muhlogger | 362/294 X |
| 4,196,544 | 4/1980 | Davis et al. | 362/294 X |
| 4,321,659 | 3/1982 | Wheeler | 362/294 X |
| 4,450,512 | 5/1984 | Kristofek | 362/294 X |

*Primary Examiner*—Peter A. Nelson
*Attorney, Agent, or Firm*—Frank D. Gilliam

[57] ABSTRACT

A simple, light weight air cooled filter arrangement for a high intensity narrow band pass filtered light fixture. In lighting fixtures such as infrared energy sources or stage lighting, it is necessary to filter a conventional broad spectrum energy source so that only energy in the desired region is transmitted. These filters which absorb energy in bands other than those being transmitted tend to become very hot particularly when high energy sources are required. A light fixture is provided having a plurality of spaced filters near a light output end. Each filter, except the outer most filter, has a portion of its outer periphery removed. These open areas are alternately positioned to form a tortuous air path between adjacent filters. A cooling fan draws filtered exterior ambient air through the tortuous paths between the filters and exits the warmed air past the energy source out the end remote from the filters. Sensors are provided for controlling the output of the energy source relative to exterior light and exiting air temperatures and the fan operation.

20 Claims, 6 Drawing Figures

AIR COOLED LIGHT FIXTURE WITH BAFFLED FLOW THROUGH A FILTER ARRAY

BACKGROUND OF THE INVENTION

This invention relates in general to light fixtures and more particularly, to an air-cooled light fixture adapted to emit a narrow spectral energy band from a broad spectral energy band high intensity light source.

Light sources such as seal beam lamps and the like include optical devices which direct the light therefrom along a narrow beam path. These lamps get exceptionally hot when confined to a small area. It is important to operate these lamps at or as near as possible to their recommended operating temperatures. Higher than optimum temperature operation reduces their life span and lower temperatures prevents the inert gas contained in many such lamps from returning tungsten from the bulb wall to the filament coils which blackens the lamp walls causing a reduced intensity output.

In the type of light fixture to which this invention is directed the required temperatures within the fixture vary. The filters must be held within a range of ambient temperatures while the lamp must be operated at a normal high temperature of several hundred degrees Fahrenheit.

In many applications of this type of a source of light from a fixture of this type, a requirement exists for the intensity of the light leaving the fixture to be varied according to the distance of the object to be illuminated, the reflectance factor of the illuminated object and the existing ambient light level. There are light sources that can be adjusted as to intensity levels by the viewer at remote locations. None of the prior art teaches automatic light intensity control at the light source which considers the variables above mentioned. It is particularly important for automatic light control when the light is used to illuminate objects picked up by television means when the objects continually vary as to distance from a few feet to several hundred feet.

U.S. Pat. No. 4,321,659 teaches the cooling of the filters by the use of an ambient air stream drawn through the filters. This system is adequate for cooling the filters used with low or medium powered light sources, but does not teach maintaining different temperatures within the housing, prevent moisture from entering the housing, provide safety shut down of the lamp if lamp temperatures fall outside of their operating perimeter.

There is a continuing need for improvements in light fixture of the type defined.

SUMMARY OF THE INVENTION

The above noted existing problems, and others, are overcome in accordance with the light fixture of this invention which basically comprises an elongated housing having a filter pack at a light emitting first end, a light source intermediate the housing end and a fan near the second end. The filter pack consists of a plurality of spaced apart filter lens having, in combination, selected energy transmitting and absorbing characteristics so that only energy in a desired spectral band is emitted. Each of the individual filters, except the filter adjacent the first end, has a portion of its periphery removed. The removed or cut away portions of each filter is arranged so as to complement each other so as to provide substantially uniform light filtration effect across the entire face of the filter pack and provide a tortuous air path between the filters. The end surfaces of two non-adjacent filters are joined by a wall parallel to the inner surface of the light fixture housing to separate the tortuous air path into two separate tortuous air paths between different adjacent filters.

A diffusion lens is provided between the light energy source and the filters to maintain a higher temperature in the general area of the light energy source. Temperature control means within the housing controls the fan operation relative to internal housing temperatures.

A sensing means is positioned on the external surface of the housing for varying the intensity of the light energy source according to the varying distance to the object to which the filtered light is directed, the reflective factor of that object, ambient light levels, etc.

An air filter is provided to prevent moisture or foreign objects from entering the housing.

An object of this invention is to provide temperature control within a light fixture having different internal temperature requirements.

Another object of this invention is to provide a light fixture capable of housing a high energy level light source and filter system.

Another object of this invention is to provide temperature sensing means associated with a fan for controlling fan operation relative to temperature requirements.

Still another object of this invention is to provide a light fixture wherein the light output intensity is constantly varied relative to external requirements.

These and other features and objects will become apparent to those in the art while reading the specifications in view of the following drawing figures wherein:

BRIEF DESCRIPTION OF THE DRAWINGS

Details of the invention and preferred embodiments thereof will be further understood upon reference to the drawings, wherein.

DETAILED DESCRIPTION OF THE INVENTION

Figure 2:
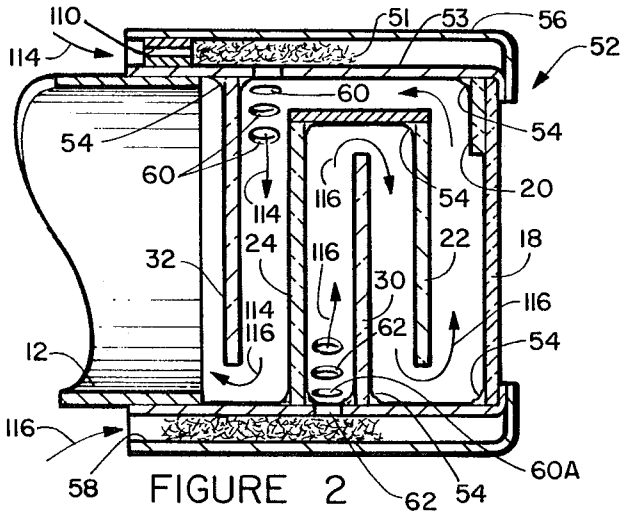
FIG. 2 is a partial cut-away side view of the lens pack assembly of a second embodiment thereof.
Figure 1:
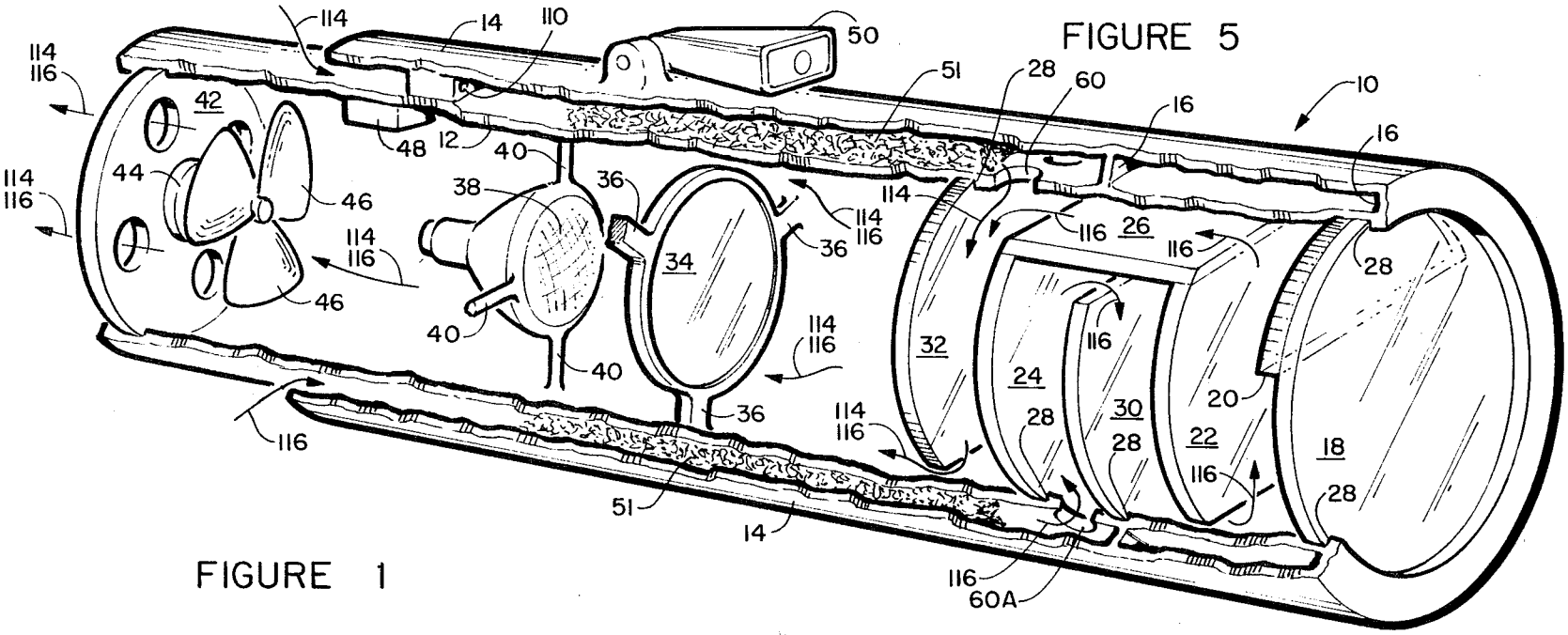
FIG. 1 is a perspective elevated partial cut-away view of the first embodiment of the fixture exposing internal components.

Referring now to FIGS. 1 and 2, there is seen a perspective, partially cut-away of one embodiment of the light fixture according to this invention. A cylindrical housing 10 surrounds and supports the internal components. Of course, housing 10 could have any other suitable shape, such as a square cross-section, and could be bent at either end, if desired.

The cylindrical housing 10 includes an inner wall 12 and an outer wall 14 spaced from wall 12. The two walls are inter connected by supports 16 located at the lens pack end of the housing 10. The lens pack includes lens 18 which takes the same general configuration as the inner wall 12 cross-section and encloses one end of the housing 10. Fixedly attached to the inner surface of lens 18 is a partial lens segment 20. Adjacent to the lens 18 and segment 20 combination is a lens 22. Lens 22 has opposite sides of its inner wall conforming periphery removed. Lens 22 is connected to a non-adjacent lens 24, which has a like inner wall conforming periphery portion removed, by a connector element or plate 26. Lens 24 is supported by inner wall 10 recesses or grooves 28 as is lens combination 18 and 20 and lens 30 which is positioned between lens 22 and 24. Lens 24 supports inter connected lens 22 in position in the housing. Lens 30 has a larger periphery area cut out than lens 22 and 24. An additional lens 32 is positioned rearward from lens 24 and like lens 22, 24 and 30 has a portion of its inner wall conforming periphery removed and is secured in a slot or groove 28 in the inner wall 12 of the housing. Lens portion 20 conforms to the inner wall conforming surface area removed from lens 30 and is the same type of light filter as is lens 30. Effectively, lens portion 20 is the inner wall conforming area removed from lens 30.

Spaced rearwardly from lens 32 is a heat baffle 34. Heat baffle 34 is centered with the lens pack and is supported from inner wall 12 by means of a plurality of spacers 36, three are shown.

Positioned rearwardly from heat baffle 34 is a high intensity light source 38 which is centered in the housing by means of spacers 40, three shown. Light source 38 will range in power, for example, between 40 and 1500 watts. The light source is electrically connected in the manner hereinafter described.

The other end of the housing 10 is closed by means of an end plate 42 with a plurality of apertures therethrough, four are shown. Mounted on end plate 42 rearward from light source 38 is a cooling fan 44 of a conventional variety. The one shown having three cooling blades 46. It should be understood that any convenient number of cooling blades 46 could be employed.

Positioned on the inner surface of wall 12 between the fan 44 and light source 38 is a temperature sensor 48 for fan control which will be more fully described hereinafter.

Positioned on the outer surface of wall 14 and directed toward the front or lens end of the housing 10 is a light sensing assembly 50. The light sensing assembly 50 which includes a light sensor element hereinafter discussed, is inter connected to the light source 38 and varies the intensity output of the light source depending on the sensed ambient light levels. The operation of the light sensing assembly 50 will hereinafter be described in more detail.

Positioned between walls 12 and 14 is a filter material 57 for filtering the cooling air entering the housing.

FIG. 2 shows a second embodiment of the housing and lens assembly or pack. In the FIG. 2 embodiment the housing 10 does not include outer wall 14. The filter pack, the same lens arrangement as FIG. 1, is held in a housing 52 by wall 53 which slip fits over the end of the housing assembly wall 12. The various lenses are attached to the inner wall of the lens housing 52 by means of adhesive 54 or the like rather than grooves 28. An outer wall 56 is connected to wall 53 at the front of the lens housing 52 forming a rearly directed opening 58. Filter material 51 is positioned between the walls 53 and 56. A plurality of openings 60 through a portion of wall 53 are positioned through a portion wall 53 between lens 24 and 32. Like openings 62 are positioned through a portion of wall 53 between lens 24 and 30.

As for the purpose of example only, to produce an infra-red light output from assembly according to FIGS. 1 and 2, lens 18 would be blue in color, lens portion 20 and lens 24 would be red in color and lens 22, 30 and 32 would be clear or transparent.

Figure 3:
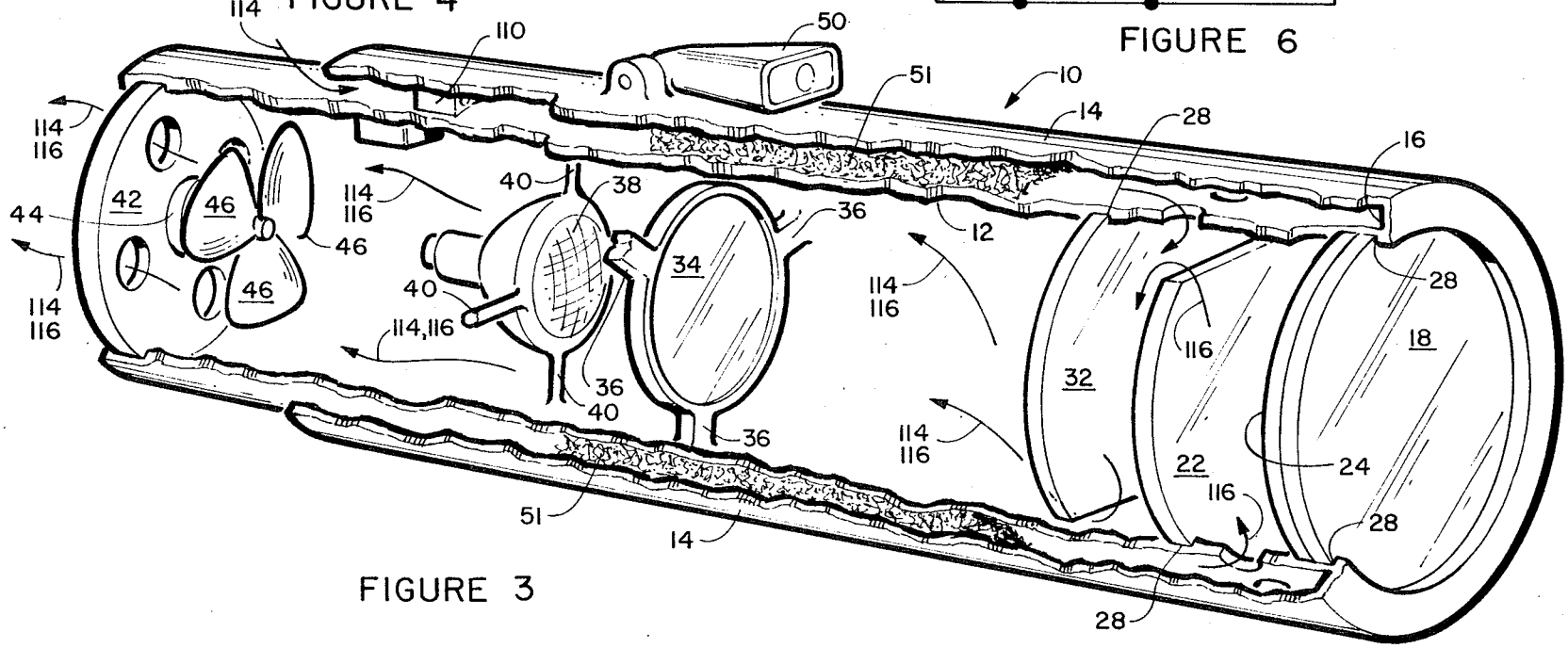
FIG. 3 is a showing similar to FIG. 1 of a second embodiment of the invention.

Referring now to the second embodiment of the air cooled light fixture of the invention shown in FIG. 3, the device is similar to the device of FIG. 1 except the lenses are positioned differently. The front most filter includes two lens 18 and 24 positioned together backed by two adjacent lens 22 and 32. The lens numbers correspond with the lens colors of the FIG. 1 and 2 devices to produce the same light frequency output.

Figure 4:
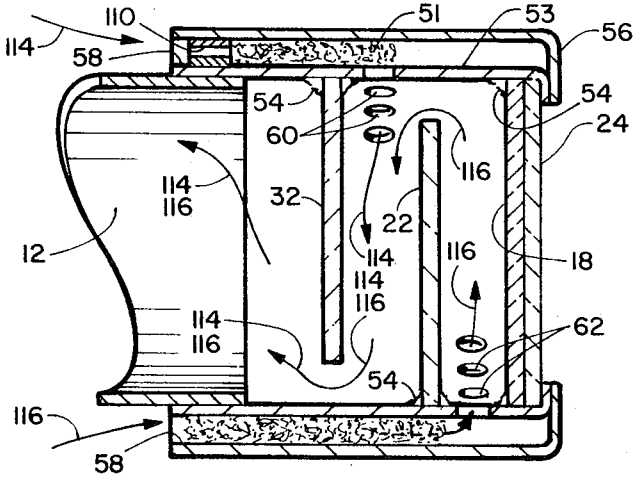
FIG. 4 is a similar showing as FIG. 2 of a second embodiment of the lens pack of FIG. 3.

Referring now to FIG. 4, the lens assembly of this embodiment is similar to the showing of FIG. 2 except for lens arrangement and the position of openings 60 and 62. In this embodiment the lens arrangement is as follows, a pair of lens 24 and 18 are positioned together with lens 24 being the forward most or outer lens of the pair. Lens 22 and 32 are positioned in a manner as lens 30 and 32 of FIG. 2. Openings 60 are positioned partially around wall 30 between lens 22 and 32 and openings 62 partially around wall 30, are positioned between lens 18 and 22.

Figure 5:
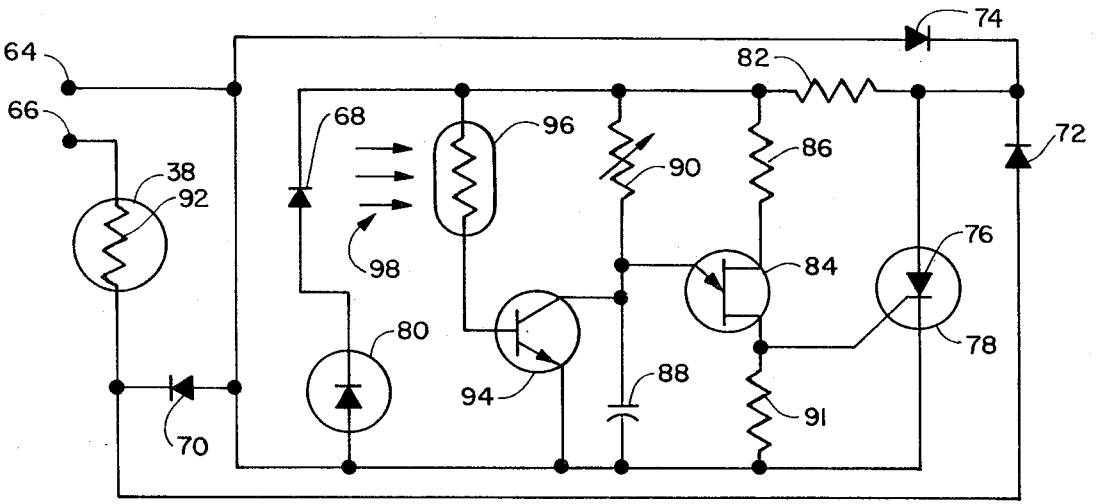
FIG. 5 is an electrical schematic of the energy source intensity control of the invention.

Referring now to the circuit diagram of FIG. 5. FIG. 5 depicts the light intensity sensing circuit enclosed in light sensor assembly 50. A 117 volt A.C. 50/60 cycle Hz power source is connected between terminals 64 and 66 which are connected to rectifiers 68, 70, 72 and 74. This full wave rectifier bridge provides direct current voltage to the anode 76 of the silicon controlled rectifier 78. The clipping action of a zener diode 80, in conjunction with resistor 82, the unijunction oscillator circuit formed by the unijunction transistor 84, resistor 86, and capacitor 88, is energized by a 20 volt clipped voltage supply. The capacitor 88 begins charging at the start of the A.C. wave from and the unijunction transistor 84, produces a pulse after a time interval, the time being determined by the value of resistor 90, in the unijunction transistor 84's emitter circuit. Since resistor 90 is a variable resistor, the time interval can be varied. As soon as the silicon controlled rectifier 78 fires, it shorts out the voltage supply to the unijunction transistor 84 which prevents capacitor 88 from charging up until the start of the next half cycle. The silicon controlled rectifier 78 then returns to its blocking state because of the power supply voltage momentarily dropping to zero. Thus, the timing of the unijunction transistor 84 is always synchronized to the start of each one half cycle of the 50/60 Hz supply voltage across terminals 64 and 66. Resistor 91 is a biasing resistor for unijunction transducer 84.

Since the full wave bridge applies full wave voltage to the silicon controlled rectifier 78, the firing angle for both half cycles is controlled by the single unijunction transistor 84 and the symmetrical phase controlled alternating current voltage is delivered to the filaments 92 of the high intensity light source 38.

An NPN transistor 94 with its emitter and collector connected across capacitor 88, receives a small current to its base from the light intensity sensor element 96, the amount of this current from sensor element 96 to the base of transistor 94 will vary according to the amount of ambient light 98 reaching the sensor element 96 controls the current flow through the transistor 94, there diverting a portion of the charging current from the capacitor. Reducing the charging current to the capacitor 88 delays the firing of the unijunction transistor 84 and silicon controlled rectifier 78 reducing the current flow through the filament 92 of lamp 38 reducing its output intensity.

If the ambient light 98 is reduced or approaches zero, the current flowing through the transistor 94 is reduced or cut off this will increase the capacitor 88 charging current which in turn increases the firing sequence of the unijunction transistor 84 and the silicon controlled rectifier 78 increasing lamp 38 filament current thus increasing the output intensity of the lamp.

The light sensing monitor 50 is positioned in the direction of the scene or object to be illuminated by the high intensity lamp 38. The reflective light from the scene or object raises or lowers the lamp intensity as hereinbefore explained. If, for example, the lamp 38 is pointed at an object that is only a short distance away, the reflected light returning to the sensor 50 will decrease the current flow through the filament 92, by this means the required illumination will always be present on the object close or far distant.

Figure 6:
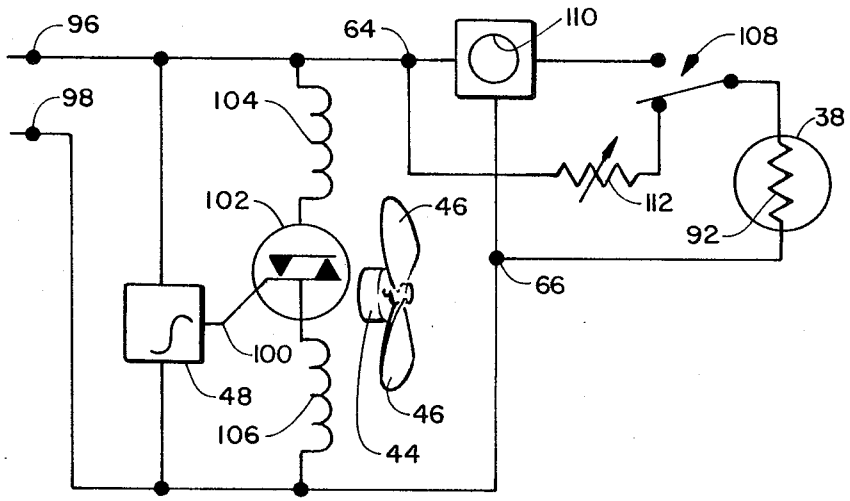
FIG. 6 is a schematic showing of the fan control system of the invention.

Referring now to FIG. 6 which depicts the temperature sensing and fan control circuit. The A.C. power source, as hereinbefore described above under the discussion of FIG. 5, is connected across terminals 96 and 98 which applies power to electronic module 48, the module 48 monitors the temperature of the inner wall 12 of the housing 10. The output 100 from module 48 turns on and varies the current flowing through the silicon diode rectifier 102 and hence through the motor coils 104 and 106 of the fan 44 wired between terminals 96 and 98. Thus, the cooling fan 44 speeds up or slows down its rotation depending on the temperature level sensed by sensor 48. The sensor 48 can be adjusted through a range of required fan speeds relative to sensed temperatures. The fan operation is independent of the operation of the high intensity lamp 38 and thus will operate according to sensed temperature levels regardless of lamp 38 operation. The circuit further includes an air switch 108 shown schematically. The air switch 108 actually is positioned in the air flow aperture 110. The aperture 110 is positioned in the air flow path between the walls of housing or housing and lens assembly. The switch is arranged so that lack of sufficient air flow through aperture 110 positions the switch 108 in the position shown in FIG. 6. in this position, the current to the lamp is removed from the sensing assembly and connected to the A.C. source at 64 through a variable preheat resistor 112.

The preheat resistor 112 has two functions, namely, it warms up the filament of lamp 38, raises the effective resistance of the filament of the lamp reducing the current through the lamp filament when the lamp is turned on, increasing the lamp life; and by applying a low voltage to the lamp 38 provides heat to the internal portion of the assembly keeping the internal components dry.

Obviously, when the fan is operating and proper air volume is drawn through aperture 110 switch 108 will change state allowing the sensor module to have control over lamp 38 illumination.

THE OPERATION OF THE EMBODIMENT

Referring now to FIG. 1, ambient air is drawn in either in the direction of arrows 114, passes through air filter 51, through aperture 60, downward between lens 24 and 32, out the bottom of lens 32, around diffused lens 34, past lamp 38 and past fan 44 out apertures 44. Ambient air is also drawn in along arrows 116, through air filter 51, through aperture 60, between lens 24 and 30, over the cutaway end of lens 30, down between lens 22 and 30, over cutaway of lens 22, up between lens 18 and 20 combination and lens 22, across connector surface 26 and down between lens 24 and 32 where it joins ambient air following arrow 114 and proceed in the same manner as that air following arrow 114.

The flow path of ambient air in FIG. 2 is substantially the same as that of FIG. 1, except ambient air, for example, first passes through the air switch aperture 110 prior to entering the assembly.

In view of the air flow paths of FIGS. 1 and 2, the air flow paths of FIGS. 3 and 4 are provided as shown by arrows 114 and 116. It should be understood that the air flow path could also be opposite to the direction of the arrows.

COMPONENT PARTS LIST

The following list of components are representative of the valves and sources used to practice this invention. It should be understood and any similar components may be used equally as well to practice this invention.

| Part Reference No. | Manufacturer | Part Number |
|---|---|---|
| 38 (lamp) | General Electric | PAR 6411 |
| 44 (fan) | Daytona | 2C610 |
| 48 (temp Sensa) | DIGI KEY | LM 3911 |
| 50 (Light sensor and Electronic control) | HB & WG | LSEC - 1001 |
| 51 (filter material) | DAYTON | L-86 |
| 68–70, 72, 74 (rectifiers) | GE Co. | GE - IN1695 |
| 78 (rectifier) | GE Co. | C11B |
| 80 (control diode) | RCA | ON1527 |
| 82 (resistor) | OMITE | 3.3K 5W |
| 88 (capacitor) | RCA | 0.1 MFD |
| 90 (resistor) | RCA | 100K, 5W |
| 91 (resistor) | OMITE | 47 OHMS, IW |
| 94 Transistor | RCA | 2M 1305 |
| 108 (air flow switch) | KLIXON | 2SEI-101-18D |
| 112 (resistor) | OMITE | 300 OHM, 75W |

The various lens are constructed of suitable translucent material, such as by way of example, and not by way of limitation, plastic, polycarbon, glass or the like dyed to a suitable color for filtering the light frequency spectrum discussed.

The housing can be constructed of any material suitable for the purpose intended herein.

It shall be understood that the fan could be reversed in rotation direction so that ambient air could be drawn in through the apertures of end plate 42 and flow opposite to the direction of the various air flow direction arrows and out through the hereinbefore discussed input openings. The filter material would be representative from its position shown in the various Figs. to the exterior of the end wall 42.

The foregoing description has been given in detail without thought of limitation, since the inventive principles involved are capable of assuming other forms without departing from the spirit of the invention or the scope of the following claims.

What is claimed is:

1. a light fixture for providing energy in narrow spectral range which comprises:

an elongated housing having openings at each end thereof;

a plurality of spaced apart filters in a pack positioned at the first end of said housing, the front most filter of said pack enclosing and sealing said first end of said housing to the passage of exterior atmosphere air therethrough, the others of said plurality of spaced apart filters having at least a portion of their outer periphery removed and are rotationally positioned to provide at least one tortuous air path between the filters of said pack and the atmosphere exterior thereof;

a broad spectrum energy source intermediate to the ends of said housing adapted to emit energy toward said filter pad; and cooling means adapted to circulate exterior atmospheric air between an opening spaced from the first end of said housing and the end of said housing opposite said first end through said at least one tortuous air path and past said energy source, whereby energy absorbed in said housing, energy source and filter pack is removed by the circulation of said air.

2. The invention as defined in claim 1 wherein a second outer wall positioned paralleled to and spaced from said housing wall forming a passageway therebetween which communicates with the space between at least one pair of non-adjacent filters of said filter pack defining with said passageway at least a portion of said tortuous air path.

3. The inventions defined in claim 1 further comprising a heat baffle positioned intermediate said broad spectrum energy source and said filter pack.

4. The invention as defined in claim 1 wherein said exterior atmospheric air is drawn in through openings adjacent said second end of said housing.

5. The invention as defined in claim 1 further comprising a filter means wherein said atmospheric exterior air is filtered prior to entering said tortuous air path.

6. The invention as defined in claim 1 further comprising a light intensity sensing means positioned exterior of said housing for sensing the intensity of ambient light and adjusting the intensity of said energy source relative thereto.

7. The invention as defined in claim 1 wherein said lens of said filter pack are arranged to provide two separate tortuous air paths therebetween.

8. The invention as defined in claim 1 further comprising temperature sensing means for terminating said energy source when the internal temperature of said housing reaches a predetermined level.

9. The invention as defined in claim 1 wherein said plurality of spaced apart filters number at least four.

10. The invention as defined in claim 1 further comprising a housing internal temperature sensing means for controlling the operation of said cooling means.

11. The light fixture as defined in claim 1 wherein said filter pack is adapted to absorb all energy emitted by said energy source except infrared energy in the 0.69 to 4 micron range.

12. The invention as defined in claim 1 wherein said filter pack removably engages the outer surface of said elongated housing whereby filter packs of different spectral ranges can be selectively interchanged on said elongated housing.

13. The invention as defined in claim 1 wherein said outer most filter comprises two separate abutting lens.

14. The invention as defined in claim 13 wherein said separate abutting lens absorb different light frequencies.

15. The invention as defined in claim 13 wherein the inter most lens of said outermost filter has he same configuration as the portion removed from a filter next non-adjacent thereto.

16. The invention as defined in claim 3 wherein said heat baffle is spaced from said housing along at least a portion of its periphery.

17. The invention as defined in claim 1 wherein said broad spectrum energy source is mounted in a spaced relationship with the walls of said housing and attached thereto along at least a portion of its outer periphery.

18. The invention as defined iin claim 1 wherein said cooling means is positioned at the second end of said housing.

19. The invention as defined in claim 1 wherein said cooling means exits said exterior air therefrom through the second end of said housing.

20. The invention as defined in claim 1 additionally comprising switch means for terminating the operation of said energy source in the absence of sufficient air flow through said tortuous air path.

* * * * *